United States Patent [19]

Leonard et al.

[11] Patent Number: 4,838,034

[45] Date of Patent: Jun. 13, 1989

[54] COMPRESSED-GAS POWER SOURCE FOR PORTABLE GAS-DRIVEN TOOLS

[75] Inventors: Rex D. Leonard; Noel E. Short, both of Indianapolis, Ind.

[73] Assignee: International Cryogenics, Inc., Indianapolis, Ind.

[21] Appl. No.: 222,791

[22] Filed: Jul. 22, 1988

[51] Int. Cl.[4] ..... F17C 7/02

[52] U.S. Cl. ..... 62/50.2; 62/52; 62/514 R; 62/51.1; 62/52.1; 417/379

[58] Field of Search ..... 62/50, 52, 514 R; 417/379

[56] References Cited

U.S. PATENT DOCUMENTS

| | | | |
|---|---|---|---|
| 1,417,292 | 5/1922 | Andrews | 62/52 |
| 2,286,050 | 6/1942 | Baker et al. | 62/52 |
| 2,454,934 | 11/1948 | Mathis et al. | 62/50 |
| 2,683,484 | 7/1954 | Falligant | 158/33 |
| 2,842,942 | 7/1958 | Johnston et al. | 62/50 |
| 2,884,943 | 5/1959 | Dobrick | 137/202 |
| 2,951,348 | 9/1960 | Loveday et al. | 62/50 |
| 2,970,452 | 2/1961 | Beckman et al. | 62/51 |
| 3,007,596 | 11/1961 | Matsch | 220/9 |
| 3,174,294 | 3/1965 | Lawrence | 62/51 |
| 3,199,303 | 8/1965 | Haumann et al. | 62/50 |
| 3,318,307 | 5/1967 | Nicastro | 128/142.2 |
| 3,578,753 | 5/1971 | Freeman, Jr. | 62/51 |
| 3,786,631 | 1/1974 | Manning et al. | 60/26 |
| 3,827,246 | 8/1974 | Moen et al. | 62/50 |
| 3,886,733 | 6/1975 | Connell | 60/39.48 |
| 3,986,359 | 10/1976 | Manning et al. | 60/508 |
| 4,023,366 | 5/1977 | Schneider | 60/671 |
| 4,149,388 | 4/1979 | Schneider et al. | 62/50 |
| 4,299,091 | 11/1981 | Carter et al. | 62/50 |
| 4,376,376 | 3/1983 | Gregory | 62/50 |
| 4,404,819 | 9/1983 | Leonard | 62/514 R |

OTHER PUBLICATIONS

Cryo-Power PAC (2 pages), distributed by Cryo--Power, Inc.

*Primary Examiner*—Ronald C. Capossela
*Attorney, Agent, or Firm*—Willian Brinks Olds Hofer Gilson & Lione

[57] ABSTRACT

A compact, portable cryogenic system for powering portable gas-driven tools having a container which includes an outer vacuum casing and an inner container with each having small, openings at their top connected together forming an evacuable space between the outer casing and the inner container. Material to inhibit heat transfer through the evacuable space is included in the space between the outer casing and the inner container. The openings of the inner container are closed with gas-tight closures fastened to the outer vacuum casing. The gas-tight closures can carry, through the single openings in the inner container, means to admit cryogenic liquid or withdraw cryogenic liquid from the inner container and means to admit heat to the inner container as may be desired. Warming coils positioned on the outer vacuum casing of the container communicate with the inner container and the flow of gas from the warming coils may be controlled by an adjustable pressure regulator.

8 Claims, 3 Drawing Sheets

COMPRESSED-GAS POWER SOURCE FOR PORTABLE GAS-DRIVEN TOOLS

TECHNICAL FIELD

This invention relates to systems used to power gas-driven tools and, more particularly, relates to a portable, cryogenic system for supplying a pressurized gas to drive pneumatic tools.

BACKGROUND ART

Cryogenic systems which provide power to pneumatically operated tools are known. Such tools may include nail drivers, screwdrivers, chisels, impact wrenches and the like. Cryogenic systems that provide oxygen supplementation for persons having restricted breathing ability are also known. Examples of such prior systems are disclosed in U.S. Pat. Nos. 4,149,388 and 4,211,086, respectively.

An important aspect for any pneumatic power source is that it must be mobile, preferably even portable, to provide driving power at the location at which the pneumatic tool is being used. At such locations it is often impractical to utilize a bulky air compressor or a heavy pressurized-gas vessel. Each of these characteristics impairs the portability of the power source; thus, a desirable power source is portable and light-weight.

Another important aspect of such a power source is ruggedness. Often the power source is used at a construction site or transported in or on the flatbed of a vehicle, such as the well of a pickup truck. The equipment is often handled roughly by those operating the equipment, and it must be able to withstand such treatment and be reliable on the job. Even a brief malfunction or breakdown of the equipment can prove costly.

One prior pneumatic power source, as disclosed in U.S. Pat. No. 4,149,388, comprises a portable cryogenic system for powering small pneumatic hand tools comprising a small dewar for storing liquid cryogen provided with an inner vessel and an outer vessel, each having a central opening at its upper portion, and an insulative layer in the volume between the inner and outer vessels. The inner vessel and outer vessel are connected in a sealing engagement by a neck portion at the central openings of each vessel. The neck portion is rigid and provides little, if any, flexibility of the inner vessel. During rough field use, the inflexibility of the neck portion may result in the breaking of the sealing engagement between the inner and outer vessels, thereby destroying the vacuum capability of the volume between the vessels, substantially diminishing the dewar's ability to store cryogenic liquid for substantial periods, and resulting in a substantially dimished useability of the power system.

The prior system was pressurized by tipping the dewar so that the cryogenic liquid stored in the inner vessel contacted the exposed portion of the bottom surface of a fluid manifold secured to the upper end of the dewar so that the cryogenic fluid was exposed to a substantial heat transfer from the ambient exterior environment. The thermal contact resulted in vaporization of a portion of the cryogenic liquid which increased the pressure within the vessel until the predetermined operating pressure is reached. The system generally operated in the pressure range from about 90 to 110 pounds per square inch (psi), and once the operable pressure was reached, a pneumatic tool could then be connected to the power source to provide the flow of pressurized gas to drive the tool. Such a procedure to build pressure was slow and required interruption in the use of the power source to build a useable pressure. In addition, in many situations, such as a worker standing on a ladder, it is impractical to have to continuously tip the dewar to maintain the operating pressure within the system.

Cryogenic breathing systems for providing supplementary oxygen to people having restricted breathing ability are also known, for example, from U.S. Pat. No. 4,211,086. This system includes a storage container for liquid oxygen and a portable container for liquid oxygen, the portable container being refillable from the stationary storage container, both containers being able to provide oxygen for breathing. Each container includes a rigid outer casing having a small opening in its top as well as an inner container having a corresponding small opening at its top. The openings of the outer casing and of the inner container are connected together by a gas-tight tubular connection forming an evacuable space between the outer casing and the inner container. The system was adapted to provide a flow of oxygen at low pressures on the order of 20 psi for breathing purposes and was not able to provide highly pressurized gas for operating pneumatic tools.

A portable system for powering pneumatic tools must be capable of withstanding the relatively high pressures needed to operate most pneumatic tools; the physical size of the container must be small enough to be of a practical and usable size; and the system should be capable of providing a continuous flow of gas at high pressure for extended practical periods of time. Such containers must be constructed in such a manner that they can pass A.S.M.E. standards for pressure vessels. The pressures under which the gas is stored are generally higher than that needed to operate pneumatic tools, which are commonly designed to operate at a pressure level of about 50 to about 80 psi. Thus, a pressure regulator is generally coupled with the power source tool to control the pressure of the gas being delivered to the tool. Gases stored at such high pressures may be dangerous if not stored and handled properly, and pressure control and relief systems are desirable to prevent damage and injury during use of such portable containers. Efforts in the past to devise a portable, pneumatic power source having the desirable characteristics discussed above have not been successful to date.

DISCLOSURE OF THE INVENTION

This invention comprises a portable, pneumatic power source which is safe, light in weight, compact, simple in structure and simple to use, and which employs a liquid cryogen, preferably nitrogen, stored under pressure as the power source to drive pneumatic tools.

In accordance with the invention, the system comprises a dewar having an outer casing and an inner vessel, each having a central opening at its respective top, a flexible neck portion carrying a flange at its upper end, and a gas-tight tubular connection sealed at its periphery with the flange. The flexible neck portion acts as a shock absorber to provide acceptance and tolerance of mechanical vibration and shock and associated variations in the spacing between the outer casing and the inner vessel caused by rough handling or transport. The dewar forms an evacuable, annular space between the outer casing and the inner container as a result of the sealed engagements of the tubular connection and the flexible neck portion with the outer casing and the inner vessel. Thermal insulation may be provided within the evacuable space to inhibit the transfer of heat from ambient to the inner vessel.

The system further includes a gas-tight manifold secured and supported by the flange of the flexible neck portion having a plurality of openings therethrough. A withdrawal tube extending outside of the outer casing is carried by the manifold in one of the openings and is connected to a warming coil which encircles the flexible neck portion. The warming coil is connected to a conduit which extends through another one of the openings formed in the manifold and is connected with a tube adapted to transfer heat within the inner vessel. The heating tube extends through another opening formed in the manifold and is connected with a second warming coil located outside of the outer casing which also encircles the flexible neck portion. The second warming coil is coupled to a pressure regulator and a fitting means adapted for connection to a pneumatic tool.

The invention also includes a filling tube carried by the manifold in one of the openings formed therein which extends outside of the outer casing, a fluid connecting means connected to the external end of the filling tube and adapted to be connected to a remote, external liquid cryogen source, and a pressure relief valve coupled to the filling tube and adapted to bleed pressure from the filling tube at a predetermined pressure level. The invention further includes a venting tube carried by the manifold in one of the openings formed therein, with the venting tube extending outside of the outer casing and being connected to a venting valve at its external end. The venting valve is movable to an opened position to depressurize the inner vessel, and also movable to a second position to permit pressurization of the inner vessel. A pressure relief valve is also coupled with the venting tube between the manifold and the venting valve.

The portable system of this invention even further includes an evacuation valve located on the outside surface of the outer casing which provides an opening to the annular space between the outer casing and the inner vessel. The evacuation valve is adapted to relieve pressure within the space when the pressure increases beyond a predetermined level and also acts to evacuably seal the space.

A protective structure is also provided by the system to maintain the mechanical integrity of the system by providing a shroud secured to the dewar extending upwardly therefrom and surrounding the elements, fluid tubes, associated coils and components to prevent damage to the elements. A reinforcing ring is also secured to the upper portion of the shroud to increase its strength and provide a means to lift and transport the system.

In use, the inner vessel is connected to an external supply source and filled with a liquid cryogen. At this time, the pressure regulator is adjusted to the required operating pressure, if not preset. The pressure within the inner vessel is measured by a pressure gauge attached to the pressure regulator. A pneumatic tool or device, if not already connected, may be connected to the pneumatic quick-disconnect fitting. When the demand valve (trigger) on the pneumatic device is actuated, the pressure differential between the system and the tool causes the liquid to flow from the inner container through the withdrawal tube, through the first warming coil and back to the inner vessel through the heating tube where it passes through a pressure-building coil immersed in the liquid cryogen. As it passes through the pressure-building coil, the liquid cryogen, which has been warmed in the first warming coil, transfers heat to the liquid cryogen stored in the inner vessel, thereby increasing the pressure within the inner vessel, which in turn forces more liquid cryogen up through the withdrawal tube to continue the cycle. The liquid cryogen is then carried from the pressure-building coil within the inner vessel through the manifold to a second warming coil which further warms and may vaporize the liquid cryogen. The vaporized cryogen is then directed through the pressure regulator and the connecting means to drive the pneumatic tool. The system remains pressurized and the system pressure is maintained until the demand valve is again actuated.

BEST MODE FOR CARRYING OUT THE INVENTION

Figure 1:
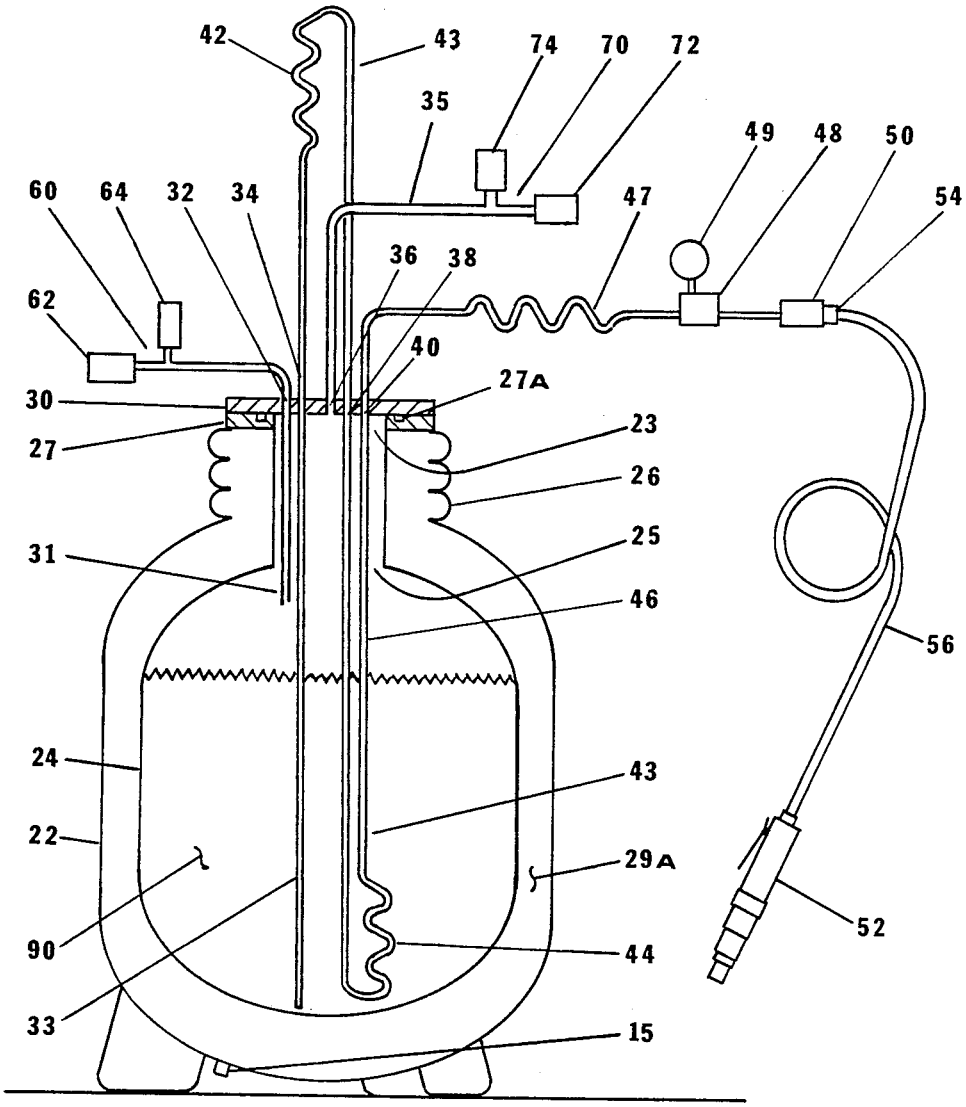
FIG. 1 is a schematic representation of a system of this invention to drive a gas-powered tool.
Figure 2:
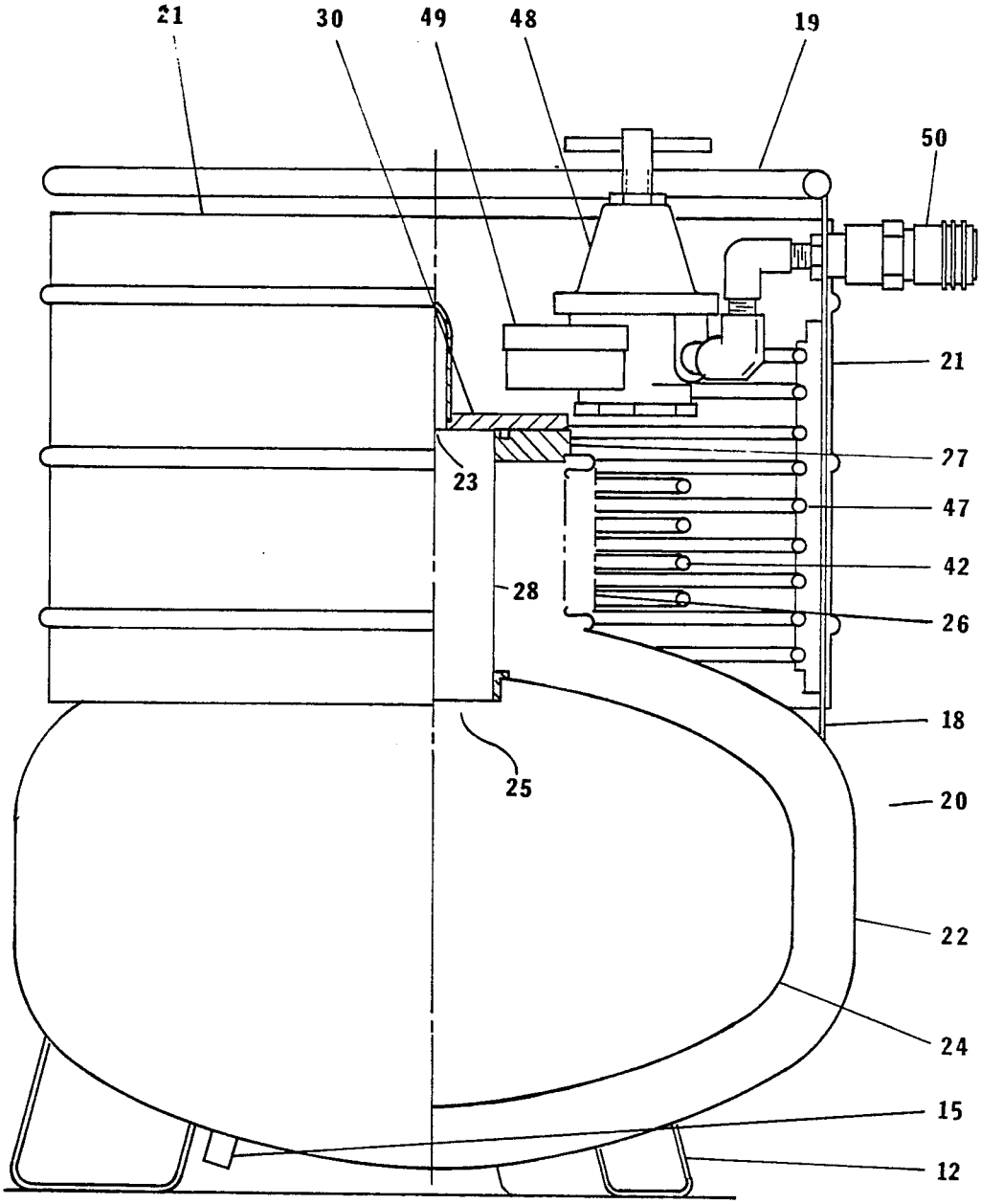
FIG. 2 is a perspective view of a cryogenic system of this invention, partially broken away to show the dewar and the warming coils.

Turning now to FIGS. 1 and 2, a cryogenic power system 10 is shown comprising a dewar 20 for storing liquefied gas 90 including an outer casing 22 and an inner vessel 24. The inner vessel is adapted to provide an A.S.M.E. pressure vessel capable of providing gas pressures in excess of 30, and up to 100 psi. Outer casing 22 and inner vessel 24 each have an opening 23 and 25, respectively, at the top. A flexible neck portion 26 extends upwardly at the upper portion of outer casing 22 and carries a flange 27 at its upper end. Outer casing 22 and inner vessel 24 are connected by a gas-tight tubular connection 28 sealed at its upper periphery with flange 27 and sealed at its lower end with inner vessel 24. Thermal insulation 29 is deposited between the outer casing and the inner vessel to inhibit heat transfer between the inner vessel and ambient. Dewar 20 thereby forms an evacuable space 29A between the outer casing and the inner vessel.

Inner vessel 24 is connected to outer casing 22 by stainless steel tubular connection 28 and flange 27. The peripheral edge of flange 27 is attached to flexible neck portion 26 creating evacuable space 29A. Flexible neck portion 26 allows the inner vessel to move independently of outer casing 22, acting as a shock absorber by providing acceptance of mechanical vibration and associated variations in the spacing between outer casing 22 and inner vessel 24, and protecting the integrity of the vacuum insulation of the system, thereby making system 10 much more able to withstand rough field use. Legs 12 (FIG. 2) are secured to the bottom of outer casing 22 to provide standing support for dewar 20 and also to provide a means to permanently mount the system, if desired.

A gas-tight manifold 30 is secured to flange 27 to provide a closure for openings 23 and 25 and to form openings 32, 34, 36, 38, and 40. Flange 27 is provided with an annular recess in which O-ring 27A is positioned to assure the secure seal between manifold 30 and flange 27. A withdrawal tube 33 is carried by manifold 30 in opening 34 and extends outside of outer casing 22 and is connected to a first warming coil 42 which, as shown in FIG. 2, encircles flexible neck portion 26. First warming coil 42 is connected to tube portion 43 which extends through opening 38 of manifold 30 and is connected to a pressure-building coil 44, which is adapted to transfer heat to liquid cryogen 90 stored within inner vessel 24. Pressure-building coil 44 is connected to tube portion 46, which extends outside of the outer casing through opening 40 of manifold 30 and is connected to a second warming coil 47 which, as shown in FIG. 2, also encircles the flexible neck portion 26. Second warming coil 47 is connected to a pressure regulating valve 48 coupled with a pressure gauge 49 and terminates in a quick-disconnect fitting device 50 adapted to be connected to a gas-operated tool 52 via a compatible quick-disconnect fitting device 54 and gas-supply hosing 56. The withdrawal tube, first warming coil, heat transfer tube, and second warming coil form a flow path for cryogen and vapor that are non-restrictive, that is, the pressure loss in the flow path does not inhibit the flow sufficiently to interfere with the operation of most gas-driven tools. System 10 is capable of supplying a flow of pressure-regulated gas to power portable, gas-operated tool 52 for long periods of time, and the pressure of inner vessel 24 may be maintained at a preset value as liquid cryogen is drawn through the system.

Power system 10 further includes a filling means 60 adapted to allow portable system 10 to be filled with liquid cryogen from an external supply source (not shown). Filling means 60 includes a filling tube 31 extending from within inner vessel 24 to outside of the outer casing and carried by opening 32 of manifold 30. The external end of filling tube 31 is connected to a fluid-connecting means 62. Fluid-connecting means 62 may comprise a quick-disconnect valve adapted to be connected to a remote, external liquid cryogen supply source. A pressure relief valve 64 is coupled to fill tube 31 at a point between manifold 30 and fluid-connecting means 62, and is adapted to bleed gas from inner vessel 24 if the internal pressure therein reaches a predetermined maximum level during filling operations.

A venting means 70 is further provided by the system of this invention including a vent tube 35 originating at opening 36 and carried by manifold 30 and extending outside of outer casing 22. Vent tube 35 is connected to a movable venting valve 72 which is movable to a first position to allow depressurization of system 10 for disassembling, repairing, storing and filling, and movable to a second position to permit the pressurization of system 10. A pressure relief valve 74, which is adapted to prevent excess pressure build-up in inner vessel 24, is coupled to vent tube 35 at a point between manifold 30 and venting valve 72.

System 10 is also provided with an evacuation valve 15 located on outer casing 22, providing access into evacuable space 29A between the inner vessel and the outer casing. Evacuation valve 15 is adapted to permit evacuation and sealing of space 29A between the inner vessel and outer casing and may comprise a plug with annular ring seals adapted to relieve pressure if pressure increases beyond a predetermined level within the space. Evacuation valve 15 is positioned, preferably, near one of legs 12 for protection during use and to prevent an accidental loss of vacuum within the space.

To meet the pressure requirements of a pneumatic tool system, inner vessel 24 is preferably formed from 16-gauge, Grade 304, stainless steel which has been roll formed and welded into an integral vessel in accordance with the A.S.M.E. Boiler and Pressure Vessel Code; and outer casing 22 is preferably formed from 16-gauge stainless steel which has also been roll formed and welded into an integral structure in accordance with the above A.S.M.E. Code. The flexible neck tube is preferably a corrugated, stainless steel, flexible hose having an inside diameter of about four inches. Such tubing is available from Flex-Weld, Inc., Barlett, Ill., Product No. FWSS-30.

To prepare for operation, inner vessel 24 is filled with liquid cryogen by connecting fluid-connecting means 62 to an external, remote liquid cryogen storage dewar through a cryogenic transfer line and, if desired, a male-female quick-disconnect valve connection. Venting valve 72 is then moved to the vent, or opened, position, thereby depressurizing inner vessel 24 and permitting it to be filled. The liquid cryogen stored in the external supply source is under high pressure and the pressure differential between depressurized inner vessel 24 and the pressurized external storage dewar forces the liquid cryogen through quick-disconnect fitting 62, through fill tube 31, and into inner vessel 24. Once inner vessel 24 is full, liquid cryogen will be discharged from vent valve 72, signaling the operator to move vent valve 72 to the closed position. Quick-disconnect device 62 is then uncoupled from the cryogenic transfer line leading to the external supply source, and system 10 is now charged and ready to use. The immediate pressure obtainable to power a gas-driven tool is measurable on pressure gauge 49, and is dependent on the saturation pressure of the liquid cryogen stored in the external supply dewar.

A gas-operated tool 52 may be connected to system 10 by coupling quick-disconnect fitting 50 with a compatible quick-disconnect fitting 54. When the demand valve on tool 52 is actuated, liquid cryogen stored in inner vessel 24 is withdrawn through withdrawal tube 33 and is directed through the first warming coil 42 where it is warmed. The warmed liquid cryogen is then directed through tube portion 43 back into inner vessel 24. Tube portion 43 directs the warmed liquid cryogen to a pressure-building coil 44, which is immersed in liquid cryogen 90, where it transfers heat to the liquid cryogen, thereby maintaining the pressure within inner vessel 24 and permitting more liquid cryogen to be withdrawn through withdrawal tube 33. The cryogen is then directed from pressure-building coil 44 through tube portion 46 which extends outside of outer casing 22 and is connected to a second warming coil 47 where the liquid cryogen is further warmed and vaporized. The now-vaporized cryogen flows through quick-disconnect fittings 50 and 54 and gas-supply hose 56 to drive the gas-operated tool 52. The pressure supplied to the tool may be monitored by viewing pressure gauge 49 and may be controlled by adjusting pressure regulator 48.

As shown in FIG. 2, the structure of system 10 provides protection to the external components of the system including regulator 48, pressure gauge 49, pressure relief valves 64 and 74, quick-disconnect fitting device 62, vent valve 72, first and second warming coils 42 and 47, by providing a shroud 21 and a bull ring 19 attached thereto. Shroud 21 is detachably secured to supports 18 which may be welded to the upper portion of outer casing 22. Bull ring 19 is attached to the upper peripheral edge of shroud 21 to provide strength and also to serve as a handle means to transport the system.

Figure 3:
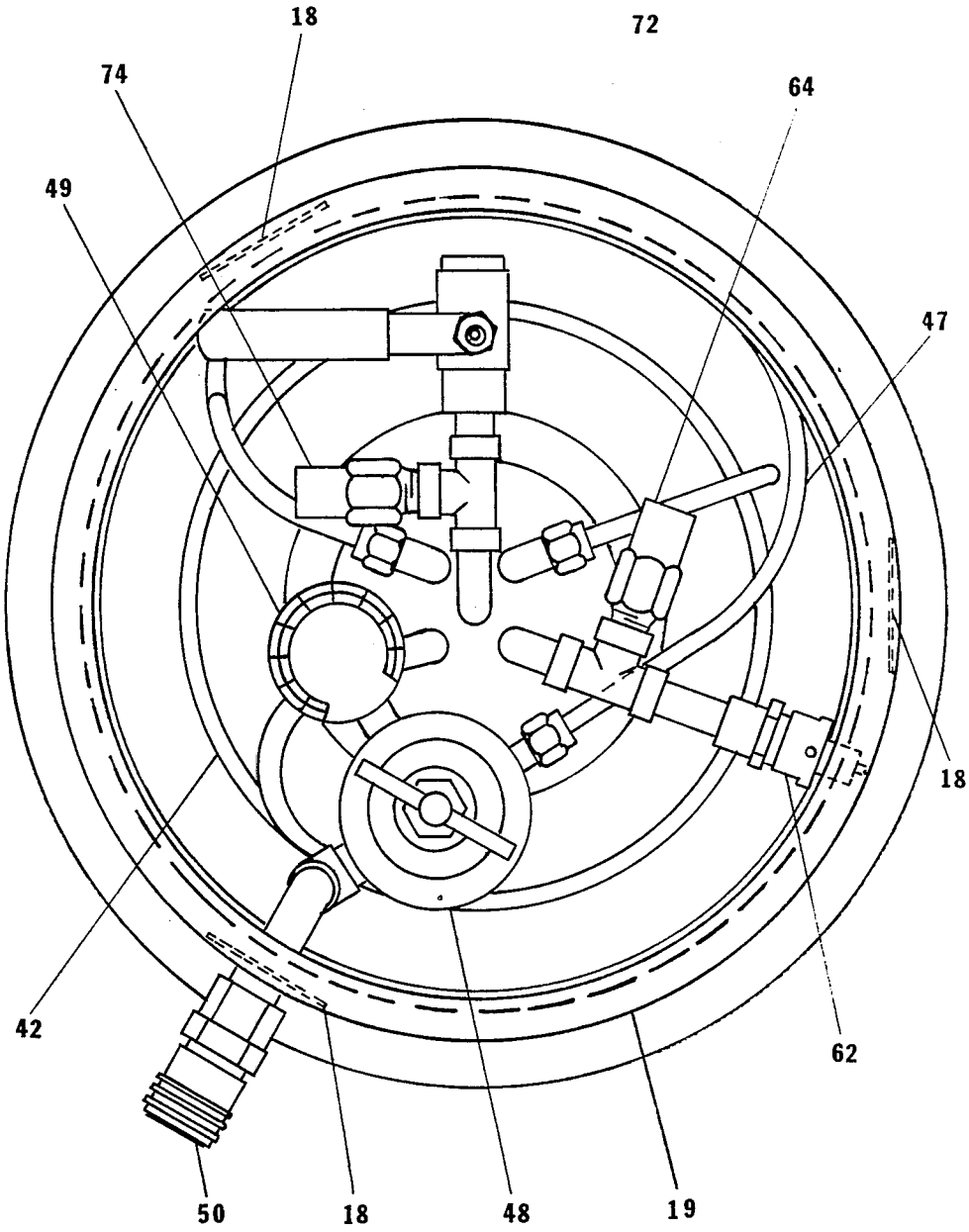
FIG. 3 is a top perspective view of FIG. 2.

Thus, the invention provides the system disclosed above in connection with the embodiments of FIGS. 1–3. It must be understood, however, that there are other embodiments and variations of the invention which may be developed, and that the invention is not limited to the preferred embodiments and best mode of operation currently understood and described herein, but is only limited by the scope of the following claims.

We claim:

1. A portable system for providing a gas under pressure sufficient to drive a gas-powered tool, comprising:

a container for storing liquefied gas including an outer casing and an inner container adapted to provide gas pressures in excess of 30 psi, the casing and container each having an opening at the top;

a flexible neck portion extending upwardly at the upper portion of the casing and carrying a flange at its upper end;

a gas-tight tubular connection sealed at its periphery with the flange, said tubular connection extending between the flange and the inner container, said flexible neck portion being adapted to provide acceptance of mechanical vibration and shock and associated variations in spacing between the outer casing and the inner container;

thermal insulation between the outer casing and inner container inhibiting heat transfer therebetween, said storage container forming an evacuable space between the outer casing and the inner container;

a gas-tight manifold for the opening of the inner container supported by the flange on the outer casing and forming a plurality of openings, said manifold being sealed to the upper end of the flexible neck portion;

a withdrawal tube carried by said manifold in one of said openings, said withdrawal tube extending outside of the outer casing and being connected with a first warming coil encircling the flexible neck portion, said first warming coil extending to another of said openings in the manifold and being connected with a tube adapted to transfer heat within the inner container, said heat transfer tube extending from within the inner container to another of said openings in the manifold where it is connected with a second warming coil for vaporizing liquid cryogen flowing therethrough, said second warming coil encircling the flexible neck portion and being connected with a pressure regulating valve; and means adapted for connection to a gas-operated tool, said withdrawal tube, first warming coil, heat-transfer tube, and second warming coil forming a non-restrictive, pressure-maintaining flow path for cryogen and vapor whereby the pressure of the inner container is maintained at a preset tool-operating value and a continuous tool-operating flow of gas can be drawn from the inner container for long periods of time.

2. The portable system for providing a gas under pressure sufficient to drive a gas-powered tool of claim 1 further comprising a filling means adapted to allow said portable system to be filled with liquid cryogen from an external liquid cryogen supply source.

3. The portable system for providing a gas under pressure sufficient to drive a gas-powered tool of claim 2 wherein said filling means comprises:

a filling conduit carried by said manifold in one of said openings, said filling conduit extending outside of outer casing;

a fluid-connecting means comprising a quick-disconnect fitting device connected to the external end of said filling conduit adapted to be connected to a remote, external liquid cryogen source; and a first pressure relief valve coupled to said filling conduit between said manifold and said fluid connecting means adapted to bleed gas from said filling conduit at a predetermined pressure level.

4. The portable system for providing a gas under pressure sufficient to drive a gas-powered tool of claim 1 further comprising a venting means allowing access to the inner container.

5. The portable system for providing a gas under pressure sufficient to drive a gas-powered tool of claim 4 wherein said venting means comprises:

a venting conduit carried by said manifold in one of said openings, said venting conduit extending outside of the outer casing;

a venting valve connected to the external end of said venting conduit, said valve movable to a first position to allow the inner container to be vented to ambient, and movable to a second position to close the inner container to ambient; and a second pressure relief valve coupled to said venting conduit between said manifold and said venting valve.

6. The portable system for providing a gas under pressure sufficient to drive a gas-powered tool of claim 1 further comprising an evacuation valve located on said outer casing providing a port therethrough into the evacuable space between said outer casing and said inner container, said evacuation valve being adapted to relieve pressure increasing beyond a predetermined level within the space, and adapted to seal the space.

7. The portable system for providing a gas under pressure sufficient to drive a gas-powered tool of claim 1 further comprising a protective means including supports secured to the upper portion of the outer casing of the storage container, a shroud means detachably secured to said supports extending upwardly a distance sufficient to provide a protective enclosure for said manifold, said withdrawal tube, said first warming coil, said second warming coil, said flexible neck portion, said regulating valve, and said connection means, and a strengthening ring secured to the upper peripheral edge of said shroud to provide strength to the upper portion of said shroud, said strengthening ring further providing a handle means to facilitate transporting said system.

8. A portable cryogenic power system capable of providing a liquid cryogen under pressure sufficient to drive a small pneumatic tool, comprising:

a dewar capable of storing a liquid cryogen provided with an inner vessel and an outer casing, said outer casing and said inner vessel each having a central opening at the top;

a flexible neck portion extending upwardly at the upper portion of the casing and carrying a flange at its upper end;

a gas-tight tubular connection sealed at its periphery with the flange, said tubular connection extending between the flange and the inner vessel, said flexible neck portion adapted to provide acceptance and tolerance of mechanical vibration and shock and associated variations in spacing between the outer casing and the inner vessel, said tubular connection thereby forming an evacuable space between the outer casing and the inner vessel;

thermal insulation deposited between the outer casing and the inner vessel, inhibiting heat transfer therebetween;

a gas-tight manifold for the central opening of the inner vessel supported by the flange on the outer casing and forming a plurality of openings;

a non-restrictive flow path, comprising:

a withdrawal tube, a first warming coil, a heat-transfer tube, and a second warming coil, said withdrawal tube being carried by said manifold in one of said openings, said withdrawal tube extending outside of the outer casing and being connected with a first warming coil, said first warming coil encircling said flexible neck portion and extending to another of said openings in said manifold and being connected with said heat-transfer tube adapted to transfer heat to the liquid cryogen stored within the inner vessel, said heat-transfer tube being carried by the manifold and extending to a pressure-building coil immersed in the liquid cryogen stored therein, said pressure-building coil extending to another of said openings in said manifold where it is connected with a second warming coil, said second warming coil being adapted to warm and vaporize liquid cryogen flowing therethrough, said second warming coil encircling the flexible neck portion and being connected with a pressure-regulating valve and a quick-disconnect fitting means for connecting the system to a pneumatic tool;

a filling means adapted to allow the system to be filled with liquid cryogen from an external supply source, said filling means comprising a filling tube extending outside of said outer casing and carried by one of said plurality of openings formed by said manifold;

a quick-disconnect fitting device connected to the external end of said filling tube adapted to be connected to a remote, external liquid cryogen source, and a first pressure relief valve coupled to the filling tube between said manifold and said quick-disconnect fitting device adapted to relieve pressure within the inner vessel at a predetermined level;

a venting means allowing access to the inner vessel chamber, said venting means comprising a venting tube extending outside of the outer casing and carried by one of said plurality of openings formed by said manifold, a second pressure relief valve coupled to said venting tube, and a venting valve coupled to the external end of said venting tube, said venting valve movable to a first position to permit the depressurization of said system, and to a second position to permit the pressurization of said system; and a gas-tight evacuation valve located on the outer casing providing access into the evacuable space between the outer casing and inner vessel, said evacuation valve being adapted to evacuate and seal said space, said portable system being capable of providing a flow of pressure-regulated liquid cryogen to drive portable pneumatic tools for long periods of time whereby the pressure within the inner vessel is maintained at a preset level.

* * * * *